United States Patent [19]

Snapka

[11] Patent Number: 4,666,310

[45] Date of Patent: May 19, 1987

[54] GLOBE CLOCKS

[76] Inventor: Charlie J. Snapka, Rte. 7, Box 103-C, Palestine, Tex. 75801

[21] Appl. No.: 851,534

[22] Filed: Apr. 14, 1986

[51] Int. Cl.[4] ..... G04B 19/22

[52] U.S. Cl. ..... 368/24; 434/143

[58] Field of Search ..... 368/21-24; 434/142-143

[56] References Cited

U.S. PATENT DOCUMENTS

| | | | |
|---|---|---|---|
| 3,049,863 | 8/1962 | Banney | 368/24 |
| 3,197,893 | 8/1965 | Mariotti | 368/24 |
| 3,305,946 | 2/1967 | Gardin | 368/24 |
| 3,370,415 | 2/1968 | McIlvaine | 368/24 |
| 3,527,046 | 9/1970 | Pawl | 368/24 |
| 3,583,150 | 6/1971 | Falk | 368/24 |
| 4,056,927 | 11/1977 | Wilson | 368/24 |
| 4,102,121 | 7/1978 | Vezay | 368/24 |
| 4,308,604 | 12/1981 | Graham | 368/23 |

*Primary Examiner*—Vit W. Miska

*Attorney, Agent, or Firm*—John M. Harrison

[57] ABSTRACT

Globe clocks for indicating time at various points in the world by illumination of such points as a function of time by light systems which simulate the sun. In a first preferred embodiment, the globe clock is characterized by a transparent or translucent globe rotatably mounted on a pedestal with a clock mechanism mounted on a shaft extending through the globe and effecting rotation of the globe at a predetermined rate of speed. A gear and linking mechanism is provided in association with the clock mechanism to facilitate sweeping movement of a light in a vertical arc inside the globe to simulate changing of the seasons as the globe rotates. In a second preferred, embodiment the globe clock is characterized by a transparent or translucent globe which is rotatably mounted on a base or console containing a clock mechanism which effects rotation of the globe at a predetermined rate of speed. A gear and linkage mechanism is provided on a shaft extending through the globe to facilitate movement of a light in a sweeping vertical arc to simulate changing of the seasons as the globe rotates.

20 Claims, 4 Drawing Figures

FIG. 1
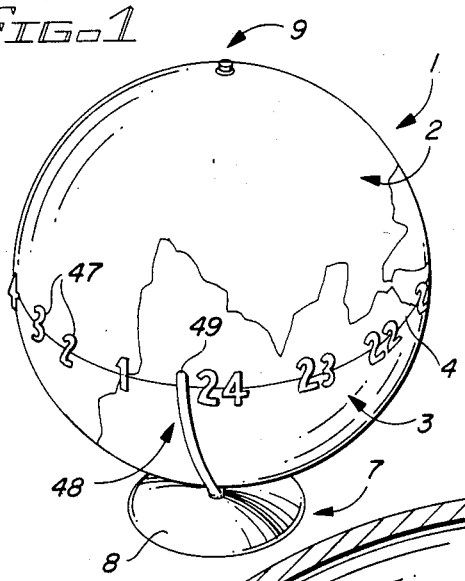
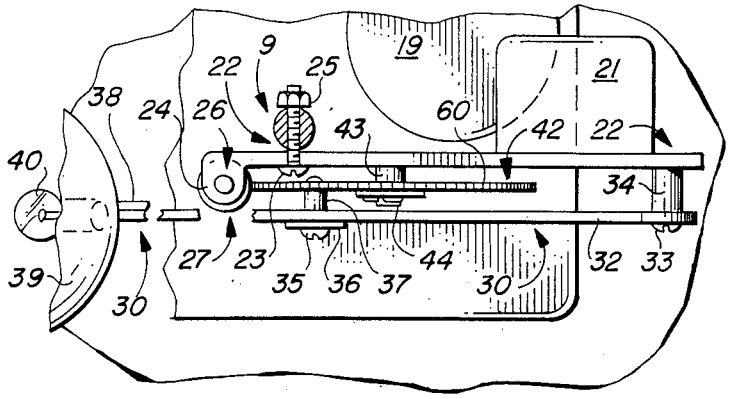
FIG. 3
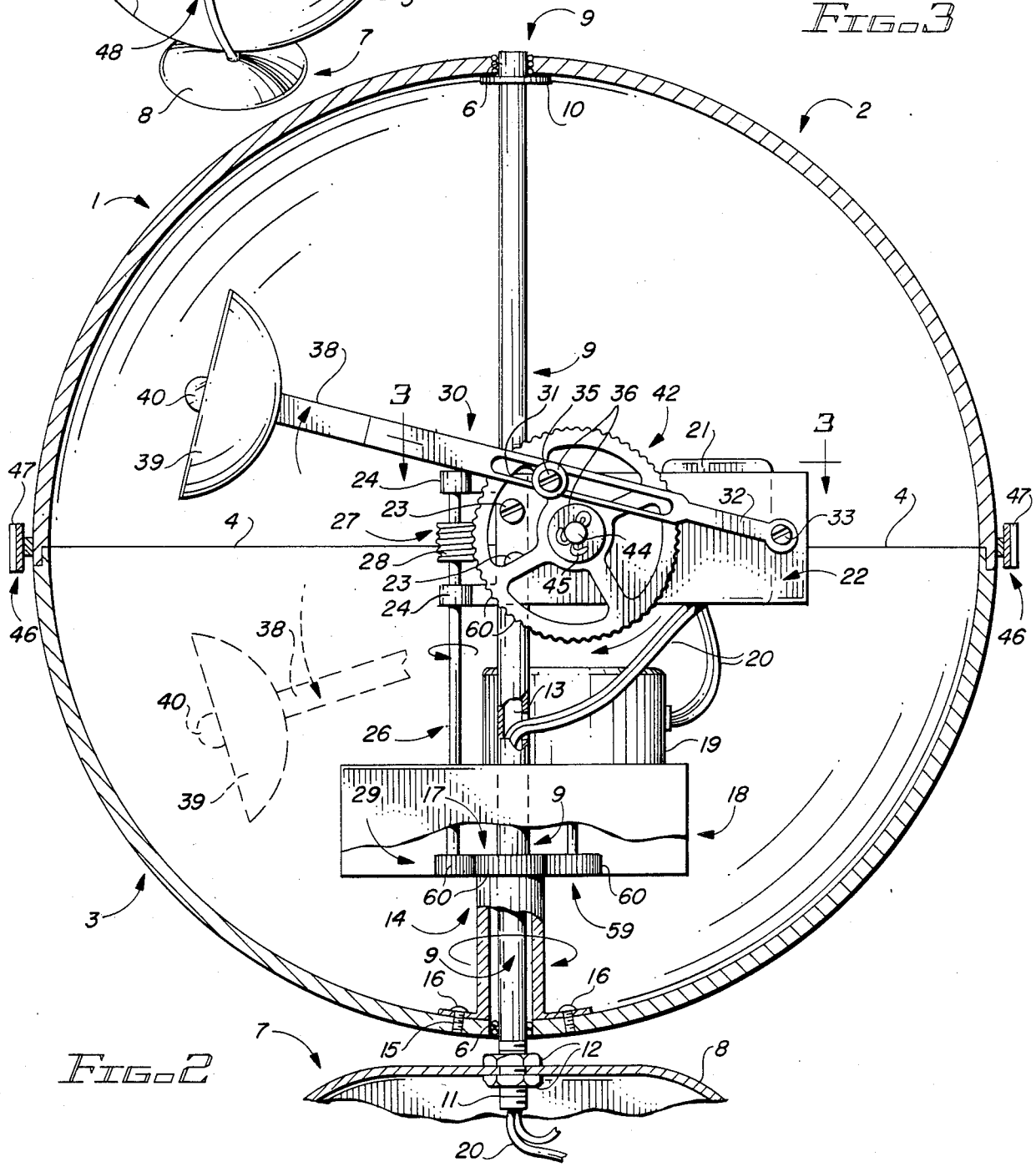
FIG. 2

GLOBE CLOCKS

BACKGROUND OF THE INVENTION

1. Field of the Invention

This invention relates to globe clocks and more particularly, to globe clocks which are characterized by clock mechanisms provided in association with gear and linkage assemblies while rotating a transparent or translucent globe at a predetermined rate of speed. The gear and linkage assemblies are designed to move a light within the globe to simulate movement of the earth with respect to the sun and indicate the current time in all parts of the world. In one embodiment, the clock mechanism is located inside the globe and is mounted on a shaft extending through the globe to effect rotation of the globe and in a second embodiment, the clock mechanism is located in a pedestal, base or console to rotate the globe.

In a most preferred embodiment of the invention, both globes are transparent or translucent in construction and revolve once every 24 hours responsive to operation of the timing or clock mechanisms, to simulate rotation of the earth. A sun lamp is mounted in each of the globes in cooperation with a linkage and gear assembly to indicate changing of the seasons as the globe turns. Accordingly, one can determine at a glance what part of the world is entering into daylight and darkness during any time interval in a 24-hour span. The gearing and linkage assemblies allow the sun to travel from the north pole to the south pole and then back again, to simulate wobble of the earth on its axis. Since the simulated sun glows 24 hours, it is an effective indicator or simulation of the actual sunlight and dark areas of the earth during the 24 hour time interval.

2. Description of the Prior Art

Various types of global clocks are known in the art. U.S. Pat. No. 3,370,415, dated Feb. 27, 1968, to H. A. McIlvaine discloses "Global Clocks" which simulate on a globe the light and dark areas of the world. "The Global Clock" includes a base upon which a globe is mounted for rotatable movement in angular relationship, with a light located within the globe and a time band provided on the globe. As the globe is rotated, the light simulates the sun and various areas of the world are illuminated to simulate rotation of the earth. U.S. Pat. No. 3,527,046, dated Sept. 8, 1970, to W. S. Pawl discloses a "Globe Map Clock". The "Globe Map Clock" of this invention is characterized by a translucent globe map having a clockwork mounted therein for rotating the globe within the northern portion of the globe about the polar axis, at the rate of one revolution per day. Gearing is provided within the globe to tilt the globe from day to day in accordance with the seasons of the year and to drive an annular scale about a pointer which indicates the day of the year automatically throughout the year. A "Time Giving Device" is disclosed in U.S. Pat. No. 4,056,927, dated Nov. 8, 1977, to James R. Wilson. This device is characterized by a globe construction for visually determing the time at a selected geographical area of the earth, including a translucent globe and a rotatable hour dial labeled by hours and having perforations through which a stationary dial with minute indicia is viewable. The rotatable dial is activated by a timing motor adapted to rotate the hour dial 360 degrees per 24 hour day. The interior of the globe is provided with a light to permit viewing the hour indicia on the hour dial and the indicia on the stationary minute dial. U.S. Pat. No. 4,102,121, dated July 25, 1978, to Robert W. Veazey discloses a three-dimensional time piece for determining the correct time anywhere in the world. This time piece includes a world globe with a 24 hour time band extending therearound and lighting is provided inside the globe to indicate both nighttime and daytime on the surface of the globe. The time piece further indicates the month of the year with changes in light and intensity on the surface of the globe, to represent the inclination of the sun and the corresponding season of the year. A "Globe Clock" is disclosed in U.S. Pat. No. 4,308,604, dated Dec. 29, 1981, to James L. G. Graham. This clock indicates different times at different places in the world and includes a globe and a dial ring rotatable in an annular groove formed around the inside of the globe at its equatorial region. The dial ring is rotated around the globe by clock movement. A time scale on the dial ring is visible through a transparent zone of the equatorial region of the globe and simultaneous times at the different places in the world are indicated by reading the time scale in conjunction with index marks provided on the globe and identifying different places in the world. U.S. Pat. No. 3,583,150, dated June 8, 1971, to Gerhard Falk, includes a World Time Indicator, wherein a shadow is cast upon a cartographic image impressed on a translucent, spherical segment which rotates by clockwork to indicate the time, as well as day and night conditions.

It is an object of this invention to provide new and improved globe clocks, one of which clocks is characterized by a timing mechanism located on a shaft positioned within a translucent globe and engaging a sleeve rotating about the shaft and connected to the globe, in order to rotate the globe about the timing mechanism, with a gearing and linkage mechanism having a light therein for indicating simulated illumination of the globe by the sun and numerals provided on the exterior of the globe and illuminated by an optional second light to identify the hour of the day or night.

Another object of this invention is to provide a new and improved globe clock which is mounted on a pedestal or base which houses a timing mechanism, with a shaft extending from the base and provided in cooperation with the timing mechanism and a translucent or transparent globe mounted on the shaft, wherein the globe is rotated by operation of the timing mechanism, and further including a gear and linkage assembly provided inside the globe and a light system mounted on the gear and linkage assembly for simulating conditions of sunlight through the various seasons as the globe rotates.

A still further object of the invention is to provide a new and improved globe clock which is characterized by a timing mechanism mounted on a shaft located inside a translucent or transparent globe and extending to a pedestal supporting the globe, with a pointer extending from the pedestal to sequential numerals provided at the equator of the globe, in order to illuminate the numerals and indicate the current time during a 24 hour interval.

SUMMARY OF THE INVENTION

These and other objects of the invention are provided in a pair of globe clocks, which in a first preferred embodiment are characterized by a translucent plastic globe rotatably mounted on a shaft extending from a pedestal, with a timing or clock mechanism located inside the globe and mounted on the shaft for effecting rotation of the globe at a predetermined speed, and a gear and linkage system provided with a lighting means for vertically sweeping the inside of the globe from north pole to south pole and back again, to simulate the motion of the earth with respect to the sun. In another preferred embodiment of the invention, a translucent plastic globe is mounted on a shaft extending from a base or cabinet having a timing or clock mechanism mounted therein, with a gear and linkage system containing a light located on the shaft adapted to vertically sweep the inside of the globe from north pole to south pole and back again as the globe rotates, to simulate movement of the earth with respect to the sun.

BRIEF DESCRIPTION OF THE DRAWINGS

The invention will be better understood by reference to the accompanying drawings, wherein;

FIG. 1 is a perspective view of a first preferred globe clock of this invention;

FIG. 2 is a sectional view of the globe clock illustrated in FIG. 1;

FIG. 3 is a sectional view taken along line 3—3 in FIG. 2, more particularly illustrating the gear and linkage assembly in the globe clock illustrated in FIG. 1.

DESCRIPTION OF THE PREFERRED EMBODIMENTS

Figure 4:
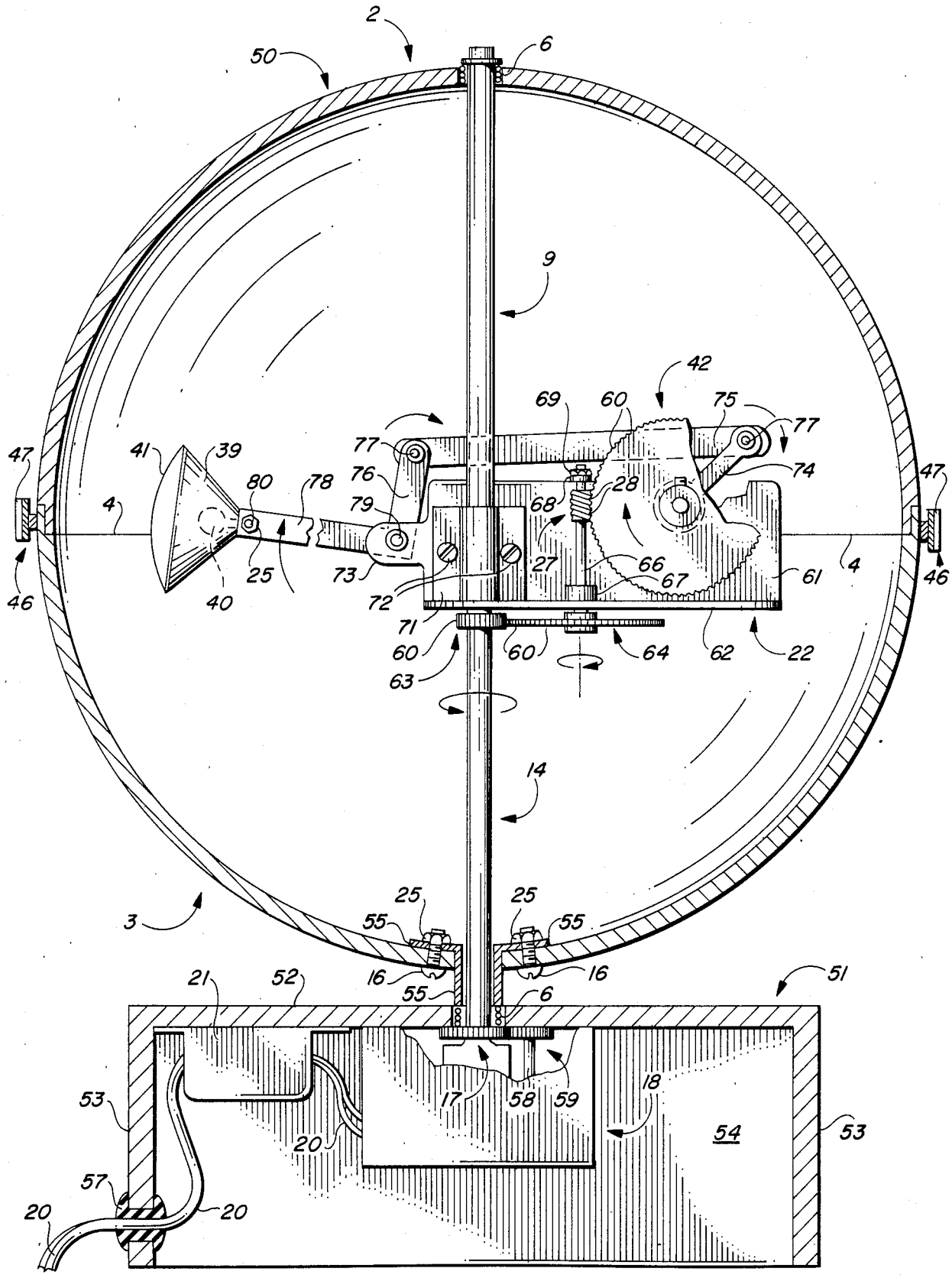
FIG. 4 is a sectional view of a second preferred globe clock of this invention.

Referring initially to FIGS. 1–3 of the drawings in a first preferred embodiment of the invention, the globe clocks of this invention are illustrated as an internal drive globe clock 1. The internal drive globe clock 1 is further characterized by a globe having a top hemisphere 2 and a bottom hemisphere 3 which join along a match line 4, as illustrated in FIGS. 1 and 2. Numerals 47, numbered sequentially from 1 to 24 are provided along the match line 4, which corresponds to the equator dividing the top hemisphere 2 and bottom hemisphere 3. As illustrated in FIG. 1, the numerals 47 can be glued or otherwise attached directly to the top hemisphere 2 or bottom hemisphere 3. Alternatively, referring to FIG. 2, the numerals 47 can be secured to a numeral ring 46, secured to either the top hemisphere 2 or bottom hemisphere 3. An optional pointer 48, equipped with a pointer light 49, projects from the pedestal 7 to illuminate the numerals 47 externally. In a most preferred embodiment of the invention, the internal drive globe clock 1 is transparent or at least translucent in construction, for purposes which will be hereinafter described. The top hemisphere 2 and bottom hemisphere 3 of the internal drive globe clock 1 are rotatably mounted on a shaft 9 supported by a pedestal 7, with the shaft 9 extending through a bearing 6 provided in the bottom hemisphere 3 and through a second bearing 6, located in the top hemisphere 2, as illustrated. A shaft washer 10 is provided on the shaft 9 beneath the top shaft aperture 5, in order to facilitate additional support of the top hemisphere 2 and the bottom hemisphere 3, as hereinafter described. The shaft 9 is secured to the pedestal top 8 of the pedestal 7 by means of shaft threads 11, to which shaft nuts 12 are secured both above and below the pedestal top 8 of the pedestal 7, as illustrated. In a preferred embodiment of the invention the shaft 9 is hollow and wiring 20 extends through the shaft bore 13 of the shaft 9 to supply current to the transformer 21 and the motor 19 and for illuminating the bulb 40, and through the optional pointer 48, to illuminate the pointer light 49, as hereinafter described. A shaft sleeve 14 is concentrically fitted over the base portion of the shaft 9 and is secured to the bottom segment of the bottom hemisphere 3 by means of a sleeve bracket 15 and cooperating bracket bolts 16, as illustrated in FIG. 2. A shaft sleeve gear 17 is mounted on the top end of the shaft sleeve 14 and engages a drive gear 59 attached to the motor shaft 58, which extends from the motor 19, also as illustrated in FIG. 2. The drive gear 59 is provided with gear teeth 60, which mesh with corresponding gear teeth 60 provided in the shaft sleeve gear 17, in order to facilitate rotation of the shaft sleeve gear 17 when the motor 19 is activated and rotate the shaft sleeve 14 and both the top hemisphere 2 and the bottom hemisphere 3, in concert. A drive shaft 26 is provided on the opposite side of the shaft 9 from the motor 19 and extends upwardly, where it is journaled for rotation in the mount plate flanges 24, provided in a mount plate 22. The bottom end of the drive shaft 26 is fitted with a shaft gear 29, the gear teeth 60 of which mesh with corresponding gear teeth 60 on the shaft sleeve gear 17, to facilitate rotation of the shaft gear 29 and the drive shaft 26 by operation of the motor 19. It will be appreciated by those skilled in the art that the drive gear 59, shaft sleeve gear 17 and the shaft gear 29 re integral components of the clock mechanism 18, which is attached to the shaft 9 by methods well known to those skilled in the art. It will further be appreciated that the size of the drive gear 59, shaft sleeve gear 17 and the shaft gear 29 are chosen so as to produce rotation of the drive shaft 26 at a selected speed, as hereinafter described.

Referring again to FIGS. 2 and 3 of the drawings the mount plate 22 is secured to the shaft 9 by means of mount plate bolts 23 and cooperating nuts 25. Furthermore, a worm gear 27, provided with worm gear threads 28, is secured to the drive shaft 26 between the mount plate flanges 24 of the mount plate 22 and the worm gear threads 28 engage corresponding gear teeth 60 of a vertically-oriented arm gear 42, as illustrated. As further illustrated in FIGS. 2 and 2, the arm gear 42 is secured to the mount plate 22 by means of an arm gear shaft 44, a shaft shim 43, a washer 36 and a cotter pin 45, which extends through the end of the arm gear shaft 44. A slotted arm 30 is pivotally attached to one end of the mount plate 22 by means of a pivot bolt shim 34 and a cooperating pivot bolt 33. The slotted arm 30 is characterized by a longitudinal arm slot 31, as illustrated in FIG. 2, and a slot bolt 35 extends through a slot bolt shim 37 for spacing the slotted arm 30 from the arm gear 42, whereby the slot bolt 35 secures the slotted arm 32 to the arm gear 42 in eccentric fashion. Accordingly, it will be appreciated that the pivot end 32 of the slotted arm 30 is pivotally attached to the mount plate 22, while the opposite or light end 38 of the slotted arm 30 projects toward the inside of the top hemisphere 2. In a most preferred embodiment, a washer 36 is provided between the head of the slot bolt 35 and the slotted arm 30 in order to facilitate easy sliding of the slot bolt 35 in the arm slot 31 during operation of the internal drive globe clock 1, as hereinafter described. A curved reflector 39 is provided on the light end 38 of the slotted arm 30 and the bulb 40 is secured inside the reflector 39 and is attached to additional wiring (not illustrated) which is provided in cooperation with the wiring 20, to illuminate the bulb 40.

Referring again to FIGS. 1-3 of the drawings the internal drive globe clock 1 is operated as follows. The clock mechanism 18 is initially set with rotation of the top hemisphere 2, the bottom hemisphere 3 and the shaft sleeve 14 of the internal drive globe clock 1 effected by adjusting the clock mechanism 18 in conventional fashion to align the bulb 40 with the zero degree meridian on the equator or at the extreme top or bottom pivoted position, at the north or south pole. Power is then supplied to the motor 19 by connecting, the wiring 20 with a source of electric current and the top hemisphere 2 and bottom hemisphere 3 of the internal drive globe clock 1 begin to rotate in concert in a counterclockwise direction when viewed from the top, at a rate of one revolution per 24 hours. This rotational speed is achieved by selecting the drive gear 59, shaft sleeve gear 17, shaft gear 29 and other appropriate gears (not illustrated) in the clock mechanism 18, such that the worm gear 27 rotates one revolution per day. This rotational speed of the worm gear 27 will effect a rotation of the arm gear 42 of one revolution per year, by selecting an arm gear 42 of proper diameter with a selected number of gear teeth 60, in order to provide the proper gearing ratio. When the motor 19 is activated, rotation of the drive gear 59 effects rotation of the shaft sleeve gear 17, which in turn, causes the shaft gear 29 and the drive shaft 26 to rotate. This rotation of the drive shaft 26 effects rotation of the worm gear 27, which causes the arm gear 42 to turn. Rotation of the arm gear 42 causes the slot bolt 35 to slide in the arm slot 31 and the light end 38 of the slotted arm 30 to traverse the inside of the top hemisphere 2 and the bottom hemisphere 3 in a vertical arc. For example, the arc traversed extends from the north pole to the south pole and then from the south pole back to the north pole, during a time interval of one year, to simulate various seasons of the year, as the top hemisphere 2 and the bottom hemisphere 3 rotate in concert about the shaft 9. As the top hemisphere 2 and the bottom hemisphere 3 rotate, the pointer light 49 located in the tip of the optional pointer 48 further illuminates the numerals 47 and indicates the current time in hours.

Referring now to FIG. 4 of the drawings in another preferred embodiment of the invention, an external drive globe clock is generally illustrated by reference numeral 50 and includes a base cabinet 51, having a top 52, sides 53, a front 54 and an open area at the rear. A clock mechanism 18 is mounted to the top 52 inside the base cabinet 51 by means of suitable fasteners (not illustrated) and supports a shaft 9, which extends upwardly from the base cabinet 51 through a bearing 6 and through the bottom hemisphere 3 and another bearing 6, located in the top hemisphere 2 of the external drive globe clock 50. As in the case of the internal drive globe clock 1 illustrated in FIGS. 1-3, the bottom hemisphere 3 of the external drive globe clock 50 is supported on a shaft sleeve 14 by means of a shaft bracket 55 and cooperating bracket bolts 16, secured by nuts 25. The shaft sleeve 14 extends upwardly from attachment to a shaft sleeve gear 17, into the interior of the bottom hemisphere 3 and a horizontally-mounted linkage drive gear 63, having multiple gear teeth 60, is provided on the top end of the shaft sleeve 14, as illustrated. The gear teeth 60 of a drive gear 59, carried by a motor shaft 58, engage the gear teeth 60 of the shaft sleeve gear 17 and serve to rotate the shaft sleeve 14 in the counterclockwise direction as viewed from the top of the external drive globe clock 50. A horizontally-mounted linkage driven gear 64, provided with gear teeth 60 which mesh with the corresponding gear teeth 60 in the linkage drive gear 63, is rotatably mounted on the mount plate flange 62 of a mount plate 22. The mount plate 22 is characterized by a mount plate web 61, which carries the mount plate flange 62, which mount plate web 61 is fixedly secured to the shaft 9 by means of a shaft bracket 71 and cooperating bracket bolts 72. In a preferred embodiment, the linkage driven gear 64 is rotatably secured to the mount plate flange 62 of the mount plate 22 by means of a driven gear shaft 66, which extends through the mount plate flange 62 and is journaled for rotation in a bottom shaft mount 67 and a top shaft mount 68, located on the mount plate flange 62 and the mount plate web 61, respectively. A top shaft nut 69 is threadably attached to the extending threaded end of the driven gear shaft 66 to maintain the linkage driven gear 64 in rotatable engagement with the linkage drive gear 63. A worm gear 27 is fixedly attached to the driven gear shaft 66 between the bottom shaft mount 67 and the top shaft mount 68 and the worm gear threads 28 of the worm gear 27 engage corresponding gear teeth 60 of a vertically-oriented arm gear 42. The arm gear 42 is rotatably mounted on the mount plate web 61 of the mount plate 22 by means of an arm gear shaft 44 and a corresponding shim (not illustrated). One end of a pivot arm 74 is pivotally attached to the arm gear shaft 44, while the opposite end of the pivot arm 74 is pivotally attached to one end of a drive arm 75 by means of a drive arm pin 77. The opposite end of the drive arm 75 is in turn pivotally connected to one end of a connector arm 76 by means of a second drive arm pin 77, while the opposite end of the connector arm 76 is fixedly attached to a light arm 78 in pivoting relationship with respect to the light arm mount 73, by means of a light arm pin 79. A reflector 39 is provided on the extending end of the light arm 78 by means of a light arm bolt 80 and cooperating nut 25. A bulb 40 is illustrated as mounted inside the reflector 39 and in a most preferred embodiment of the invention, a thin time marker 41 vertically bisects the reflector 39 and faces the inside surface of the top hemisphere 2 and the bottom hemisphere 3, as illustrated, in order to cast a vertical shadow across the inside surface of the top hemisphere 2 and bottom hemisphere 3, which shadow is visible through the translucent plastic top hemisphere 2 and bottom hemisphere 3.

Referring again to FIG. 4, it will be appreciated that when current is supplied to the transformer 21 and the motor (not illustrated) in the clock mechanism 18, the shaft sleeve 14 is caused to rotate in the direction indicated by the arrow. This rotation causes the drive gear 59, the shaft sleeve gear 17, the linkage drive gear 63 and the linkage driven gear 64 to rotate, which motion effects rotation in the worm gear 27 and the cooperating arm gear 42. Rotation of the arm gear 42 effects translational motion in the pivot arm 74, drive arm 75, connector arm 76 and light arm 78, to effect a sweeping of the reflector 39 and cooperating bulb in a vertical arc to cast a shadow along the curved inside surface of the top hemisphere 2 and the bottom hemisphere 3, from the north pole to the south pole and back to the north pole. The shadow can be seen from outside the top hemisphere 2 and bottom hemisphere 3 and is noted with reference to the numerals 47 as the numerals 47 rotate. As in the case of the internal drive globe clock 1, the gearing in the clock mechanism 18, as well as the relative sizes of the drive gear 59, shaft sleeve gear 17, linkage drive gear 63, linkage driven gear 64 and the arm gear 42, can be chosen such that the top hemisphere 2 and the bottom hemisphere 3 rotate in concert at a speed of one revolution per day and the reflector 39 traverses the top hemisphere 2 and bottom hemisphere 3 from the north pole to the south pole and back in a one year cycle.

It will be recognized by those skilled in the art that the globe clocks of this invention provide versatile and decorative means for determining the time as well as daylight and darkness conditions of various parts of the world at a glance. The globe clocks can be pedestal-mounted or suspended, as desired, and when pedestal-mounted, may be either vertically oriented with respect to the base or support, as illustrated in FIGS. 1 and 4, or mounted in angular relationship with respect to the base, as desired. Furthermore, while the motor 19 in the internal drive globe clock 1 and the motor (not illustrated) in the external drive globe clock 50 are preferably driven by conventional 115 volt current, in a most preferred embodiment, the transformer 21 in the internal drive globe clock 1 and a second transformer (not illustrated) located in the external drive globe clock 50, are used to step the 115 volt current down to 6 or 14 volts D.C. This voltage serves to illuminate the bulbs 40 and optional pointer light 49 in both the internal drive globe clock 1 and the external drive globe clock 50.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is;

1. A globe clock comprising a generally spherically-shaped globe; a shaft projecting substantially through the center of said globe, with one end of said shaft extending through the bottom of said globe; support means receiving said one end of said shaft in fixed relationship for elevating said globe; shaft sleeve means rotatably provided in concentric relationship on said shaft, said shaft sleeve means fixedly attached to said globe; first illumination means carried by said shaft inside said globe and engaging said shaft sleeve means; and timing means engaging said shaft sleeve means for rotating said shaft sleeve means and said globe and operating said illumination means to illuminate selected areas inside of said globe.

2. The globe clock of claim 1 wherein said support means is a pedestal and said timing means is fixedly attached to said shaft and is located inside said globe.

3. The globe clock of claim 1 further comprising numerals provided around the circumference of said globe substantially at the equator of said globe and second light means extending from said support means to said equator for illuminating said numerals as said globe rotates.

4. The globe clock of claim 1 wherein said support means is a pedestal and said timing means is fixedly attached to said shaft and is located inside said globe and further comprising numerals provided around the circumference of said globe substantially at the equator of said globe and second light means extending from said pedestal to said equator for illuminating said numerals as said globe rotates.

5. The globe clock of claim 1 wherein said support means is an enclosure and said timing means is located inside said enclosure.

6. The globe clock of claim 1 wherein said support means is an enclosure and said timing means is located inside said enclosure and further comprising numerals provided around the circumference of said globe substantially at the equator of said globe and second light means extending from said enclosure to said equator for illuminating said numerals as said globe rotates.

7. The globe clock of claim 1 wherein said first illumination means further comprises driven gear means provided in association with said timing means and said shaft sleeve means for rotating said shaft sleeve means and said globe responsive to operation of said timing means; a mount plate extending from fixed attachment to said shaft; an arm pivotally carried by said mount plate and a slot provided in longtudinal orientation in said arm; light means secured to the free end of said arm, said light means facing the inside surface of said globe; arm gear means provided in cooperation with said drive gear means and said arm, whereby said arm is caused to pivot on said mount plate and causes said light means to vertically traverse said inside surface of said globe responsive to operation of said timing means.

8. The globe clock of claim 7 wherein said support means is a pedestal and said timing means is fixedly attached to said shaft and is located inside said globe.

9. The globe clock of claim 7 further comprising numerals provided around the circumference of said globe substantially at the equator of said globe and second light means extending from said support means to said equator for illuminating said numerals as said globe rotates.

10. The globe clock of claim 7 wherein said support means is a pedestal and said timing means is fixedly attached to said shaft and is located inside said globe and further comprising numerals provided around the circumference of said globe substantially at the equator of said globe and second light means extending from said pedestal to said equator for illuminating said numerals as said globe rotates.

11. The globe clock of claim 10 wherein said timing means is characterized by a clock mechanism provided with a motor and a drive gear driven by said motor and wherein said drive gear is positioned in engagement with said driven gear means.

12. The globe clock of claim 11 further comprising a transformer provided in cooperation with said clock mechanism for reducing the current supplied to said first and second light means.

13. The globe clock of claim 1 wherein said first illumination means further comprises a shaft sleeve gear carried by said shaft sleeve means and provided in association with said timing means for rotating said shaft sleeve means and said globe responsive to operation of said timing means; a linkage drive gear fixedly carried by said shaft sleeve means inside said globe; a mount plate extending from fixed attachment to said shaft; arm linkage means pivotally carried by said mount plate and light means secured to said arm linkage means, said light means facing the inside surface of said globe; a linkage driven gear provided in cooperation with said arm linkage means and said linkage drive gear, whereby said light means is caused to vertically traverse said inside surface of said globe responsive to operation of said timing means and articulation of said linkage means.

14. The globe clock of claim 13 wherein said support means is an enclosure and said timing means is located inside said enclosure.

15. The globe clock of claim 13 further comprising numerals provided around the circumference of said globe substantially at the equator of said globe and second light means extending from said support means to said equator for illuminating said numerals as said globe rotates.

16. The globe clock of claim 13 wherein said support means is an enclosure and said timing means is located inside said enclosure and further comprising numerals provided around the circumference of said globe substantially at the equator of said globe and second light means extending from said enclosure to said equator for illuminating said numerals as said globe rotates.

17. An external drive globe clock comprising a top hemisphere and a bottom hemisphere joined along a match line to define a globe; a shaft projecting substantially through the center of said globe, with one end of said shaft extending through said bottom hemisphere of said globe and the opposite end of said shaft projecting through said top hemisphere of said globe; a hollow pedestal receiving said one end of said shaft; a shaft sleeve rotatably provided on said shaft, said shaft sleeve fixedly attached to said lower hemisphere of said globe; a shaft sleeve gear located inside said hollow pedestal and provided on said shaft sleeve; timing means fixedly mounted in said hollow pedestal and a motor provided in said timing means; a motor shaft carried by said motor and a drive gear provided on said motor shaft, said drive gear engaging said shaft sleeve gear; a linkage drive gear provided on said shaft sleeve in spaced relationship with respect to said shaft sleeve gear; and first illumination means engaging said linkage drive gear and fixedly carried by said shaft inside said globe for illuminating selected areas inside said globe responsive to operation of said timing means and said motor.

18. The external drive clock of claim 17 wherein said first illumination means further comprises a linkage driven gear engaging said linkage drive gear provided on said shaft sleeve; a driven gear shaft attached to said linkage driven gear; a worm gear vertically positioned on said driven gear shaft; a mount plate extending from fixed attachment to said shaft; an arm pivotally carried by said mount plate and a slot provided in longtudinal orientation in said arm; light means secured to the free end of said arm, said light means facing the inside surface of said globe; a vertically oriented arm gear engaging said worm gear, whereby said light means is caused to vertically traverse said inside surface of said globe responsive to operation of said timing means.

19. An internal drive globe clock comprising a top hemisphere and a bottom hemisphere joined along a match line to define a globe; a shaft projecting substantially through the center of said globe, with one end of said shaft extending through said bottom hemisphere of said globe and the opposite end of said shaft projecting through said top hemisphere of said globe; a pedestal fixedly receiving said one end of said shaft for supporting said globe in elevated configuration; a shaft sleeve concentrically and rotatably oriented on said shaft and fixedly attached to said bottom hemisphere of said globe; a shaft sleeve gear provided on the upper end of said shaft sleeve; a motor and timing means fixedly carried by said shaft inside said bottom hemisphere; a motor shaft carried by said motor and a drive gear provided on said motor shaft, said drive gear engaging said shaft sleeve gear; a shaft gear engaging said shaft sleeve gear and a drive shaft projecting from said shaft gear inside said lower hemisphere of said globe; a worm gear carried by said drive shaft; and first illumination means engaging said worm gear and fixedly carried by said shaft inside said globe for illuminating selected areas inside said globe responsive to operation of said timing means and said motor.

20. The internal drive globe clock of claim 19 wherein said first illumination means further comprises a vertically oriented arm gear engaging said worm gear; a mount plate extending from fixed attachment to said shaft; arm linkage means engaging said arm gear in eccentric relationship and pivotally carried by said mount plate and light means secured to said arm linkage means, said light means facing the inside surface of said globe, whereby said light means is caused to vertically traverse said inside surface of said globe responsive to operation of said timing means and articulation of said arm linkage means.

* * * * *